US009514863B2

(12) United States Patent
Fukuda et al.

(10) Patent No.: US 9,514,863 B2
(45) Date of Patent: Dec. 6, 2016

(54) INVERTER SURGE-RESISTANT INSULATED WIRE AND METHOD OF PRODUCING THE SAME

(71) Applicants: FURUKAWA ELECTRIC CO., LTD., Tokyo (JP); FURUKAWA MAGNET WIRE CO., LTD., Tokyo (JP)

(72) Inventors: Hideo Fukuda, Tokyo (JP); Daisuke Muto, Tokyo (JP); Dai Fujiwara, Tokyo (JP); Keiichi Tomizawa, Tokyo (JP); Tsuneo Aoi, Tokyo (JP)

(73) Assignees: FURUKAWA ELECTRIC CO., LTD., Tokyo (JP); FURUKAWA MAGNET WIRE CO., LTD., Tokyo (JP)

( * ) Notice: Subject to any disclaimer, the term of this patent is extended or adjusted under 35 U.S.C. 154(b) by 0 days.

(21) Appl. No.: 14/507,226

(22) Filed: Oct. 6, 2014

(65) Prior Publication Data

US 2015/0027748 A1 Jan. 29, 2015

Related U.S. Application Data

(63) Continuation of application No. PCT/JP2013/081300, filed on Nov. 20, 2013.

(30) Foreign Application Priority Data

Nov. 30, 2012 (JP) ..... 2012-263749

(51) Int. Cl.

| | |
|---|---|
| ***H01B 3/00*** | (2006.01) |
| ***H01B 13/14*** | (2006.01) |
| ***H01B 13/06*** | (2006.01) |
| ***H01B 3/30*** | (2006.01) |
| ***H01B 3/42*** | (2006.01) |
| ***H01B 7/02*** | (2006.01) |

(52) U.S. Cl.

CPC ..... *H01B 13/148* (2013.01); *H01B 3/301* (2013.01); *H01B 3/305* (2013.01); *H01B 3/306* (2013.01); *H01B 3/427* (2013.01); *H01B 7/0225* (2013.01); *H01B 7/0283* (2013.01); *H01B 13/065* (2013.01); *H01B 13/14* (2013.01)

(58) Field of Classification Search

USPC ..... 174/110 R, 110 A–110 PM, 120 R, 174/120 AR, 121 R

See application file for complete search history.

(56) References Cited

U.S. PATENT DOCUMENTS

| | | | | |
|---|---|---|---|---|
| 4,716,079 | A | 12/1987 | Sano et al. | |
| 2011/0226508 | A1* | 9/2011 | Aoi | H01B 3/427 174/120 SR |
| 2013/0037304 | A1 | 2/2013 | Ikeda et al. | |

FOREIGN PATENT DOCUMENTS

| | | | | |
|---|---|---|---|---|
| JP | 61-269808 | A | 11/1986 | |
| JP | 62-200605 | A | 9/1987 | |
| JP | 63-29412 | A | 2/1988 | |
| JP | 63-195913 | A | 8/1988 | |
| JP | 2-250209 | A | 10/1990 | |
| JP | 7-31944 | B2 | 4/1995 | |
| JP | 2005-203334 | * | 7/2005 | H01B 7/02 |
| JP | 2005-203334 | A | 7/2005 | |
| JP | 2008-288106 | A | 11/2008 | |
| JP | 2010-12339 | A | 6/2010 | |
| JP | 2011-9200 | A | 1/2011 | |
| JP | 2013-41700 | A | 3/2013 | |
| WO | WO 2010/024359 | A1 | 3/2010 | |

OTHER PUBLICATIONS

International Search Report, issued in PCT/JP2013/081300, dated Jan. 14, 2014.

Office Action issued in Japanese Patent Application No. 2012-263749 dated Mar. 19, 2013.

Extended European Search Report dated Dec. 7, 2015 for corresponding Application No. 13858435.4.

* cited by examiner

*Primary Examiner* — William H Mayo, III

(74) *Attorney, Agent, or Firm* — Birch, Stewart, Kolasch & Birch, LLP

(57) ABSTRACT

An inverter surge-resistant insulated wire has a baked enamel layer(s) around the outer periphery of a conductor having a rectangular cross-section, an extrusion-coated resin layer(s) around the outer side thereof, and an adhesive layer having a thickness of 2-20 μm between the baked enamel layer and the extrusion-coated resin layer. A cross-sectional shape of the baked enamel layer and the extrusion-coated resin layer in the cross-section of the wire is rectangular. In the cross-sectional shape formed by the baked enamel layer and the extrusion-coated resin layer surrounding the conductor in a cross-sectional view, at least a pair of two sides of two pairs of two sides opposing at the upper side and the downside or at the right side and the left side with respect to the conductor meet the conditions that a total thickness of the baked enamel layer and the extrusion-coated resin layer is 80 μm or more.

7 Claims, No Drawings

INVERTER SURGE-RESISTANT INSULATED WIRE AND METHOD OF PRODUCING THE SAME

CROSS-REFERENCE TO RELATED APPLICATIONS

This application is a continuation of PCT/JP2013/081300 filed on Nov. 20, 2013 which claims benefit of Japanese Patent Application No. 2012-263749 filed on Nov. 30, 2012, the subject matters of which are incorporated herein by reference in their entirety.

TECHNICAL FIELD

The present invention relates to an inverter surge-resistant insulated wire and a method of producing the same.

BACKGROUND ART

Inverters have been employed in many types of electrical equipments, as an efficient variable-speed control unit. Inverters are switched at a frequency of several kHz to tens of kHz, to cause a surge voltage at every pulse thereof. Inverter surge is a phenomenon in which reflection occurs at a breakpoint of impedance, for example, at a starting end, a termination end, or the like of a connected wire in the propagation system, followed by applying a voltage twice as high as the inverter output voltage at the maximum. In particular, an output pulse occurred due to a high-speed switching device, such as an IGBT, is high in steep voltage rise. Accordingly, even if a connection cable is short, the surge voltage is high, and voltage decay due to the connection cable is also low. As a result, a voltage almost twice as high as the inverter output voltage occurs.

As coils for electrical equipments, such as inverter-related equipments, for example, high-speed switching devices, inverter motors, and transformers, insulated wires made of enameled wires are mainly used as magnet wires in the coils. Further, as described above, since a voltage almost twice as high as the inverter output voltage is applied in inverter-related equipments, it has become required to minimize the inverter surge deterioration of the enameled wire, which is one of the materials constituting the coils of those electrical equipments.

In the meantime, partial discharge deterioration is a complicated phenomenon in which an electrical-insulation material undergoes, for example, molecular chain breakage deterioration caused by collision with charged particles that have been generated by partial discharge of the insulating material, sputtering deterioration, thermal fusion or thermal decomposition deterioration caused by local temperature rise, and chemical deterioration caused by ozone generated due to discharge. For this reason, reduction in thickness, for example, is observed in the electrical-insulation materials, which have been deteriorated as a result of actual partial discharge.

It has been believed that inverter surge deterioration of an insulated wire also proceeds by the same mechanism as in the case of general partial discharge deterioration. Namely, inverter surge deterioration of an enameled wire is a phenomenon in which partial discharge occurs in the insulated wire due to the surge voltage with a high peak value, which is occurred at the inverter, and the coating of the insulated wire causes partial discharge deterioration as a result of the partial discharge; in other words, the inverter surge deterioration of an insulated wire is high-frequency partial discharge deterioration.

In order to prevent the inverter surge deterioration, insulated wires that are able to withstand several hundred volts of surge voltage have been required for the recent electrical equipment. That is, there is a demand for insulated wires that have a partial discharge inception voltage of 500 V or more. Herein, the partial discharge inception voltage is a value that is measured by a commercially available apparatus called partial discharge tester. Measurement temperature, frequency of the alternating current voltage to be used, measurement sensitivity, and the like are values that may vary as necessary, but the above-mentioned value is an effective value of the voltage at which partial discharge occurs, which is measured at 25° C., 50 Hz, and 10 pC.

When the partial discharge inception voltage is measured, a method is used in which the most severe condition possible in the case where the insulated wire is used as a magnet wire is envisaged, and a specimen shape is formed which can be observed in between two closely contacting insulated wires. For example, in the case of an insulated wire having a circular cross-section, two insulated wires are brought into linear contact by spiral twisting the wires together, and a voltage is applied between the two insulated wires. Alternatively, in the case of an insulated wire having a rectangular cross-section, use is made of a method of bringing two insulated wires into planar contact through the planes, which are the long sides of the insulated wires, and applying a voltage between the two insulated wires.

In order to obtain an insulated wire that does not cause partial discharge, that is, having a high partial discharge inception voltage, so as to prevent the deterioration of the enamel layer of the insulated wire caused by the partial discharge, it is thought to utilize a method of using a resin having a low dielectric constant in the enamel layer or increasing the thickness of the enamel layer. However, the resins of commonly used resin varnishes generally have a dielectric constant between 3 and 5, and none of the resins have particular low dielectric constant. Further, upon considering other properties (heat resistance, solvent resistance, flexibility, and the like) required from the enamel layer, it is not necessarily possible to select actually a resin having a low dielectric constant. Therefore, in order to obtain a high partial discharge inception voltage, it is indispensable to increase the thickness of the enamel layer. When the resins having a dielectric constant of 3 to 5 are used in the enamel layer, if it is intended to obtain a targeted partial discharge inception voltage of 500 V or higher, it is necessary based on the experience to set the thickness of the enamel layer at 60 tem or more.

However, to thicken the enamel layer, the number of times for passing through a baking furnace increases in a production process thereof, whereby making a film composed of copper oxide on a copper conductor surface thicker, this in turn, causing lowering in adhesion between the conductor and the backed enamel layer. For example, in the case of obtaining an enamel layer with thickness 60 μm or more, the number of passages through the baking furnace exceeds 12 times. It has been known that if this number of passages exceeds 12 times, the adhesive force between the conductor and the enamel layer is conspicuously lowered.

It is also thought to utilize a method of increasing the thickness that can be formed by a single baking step, in order not to increase the number of passages through the baking furnace. However, this method has a drawback that the solvent of the varnish is not completely vaporized and remains in the enamel layer as voids.

In the meantime, conventionally, attempts to enhance properties (properties other than the partial discharge inception voltage) by providing a coated resin at the outer side of the enamel wire were made. For example, Patent Literatures 1 and 2 are cited as a conventional art of providing an extrusion-coated layer on an enamel layer. In the insulated wire that has been provided with the coated resin, adhesiveness between the enamel layer and the coated resin is also required. However, the techniques disclosed in Patent Literatures 1 and 2 were not necessarily satisfactory for the thickness of the enamel layer or the extrusion-coated layer or the like, from the standpoint of balancing between the partial discharge inception voltage and the adhesiveness between the conductor and the enamel layer.

On the other hand, Patent Literature 3 is cited as a conventional art of addressing problems stemming from the partial discharge inception voltage and the adhesiveness between the conductor and the enamel layer.

Further, it has become demanded to further improve various performances, such as heat resistance, mechanical properties, chemical properties, electrical properties, and reliability, in the electrical equipments developed in recent years, as compared to the conventional electrical equipments. Under the situations, excellent abrasion resistance, thermal aging resistance property, and solvent resistance have become required from insulated wires, such as enameled wires, that are used as magnet wires for electrical equipments for aerospace use, electrical equipments for aircraft, electrical equipments for nuclear power, electrical equipments for energy, and electrical equipments for automobiles. For example, in the recent years, for electrical equipments, it sometimes has been required to show an excellent thermal aging resistance over a long period of time of use.

On the other hand, recently, advance of the electrical equipment represented by motors or transformers, has been progressed resulting in size reduction and improved performance, and thus it becomes usual in many cases that insulated wires are used in such a way that they are pushed into a quite small space to pack. Specifically, it is no exaggeration to say that the performance of a rotator, such as a motor, is determined by how many electrical wires can be held in a stator slot. As a result, the ratio of the sectional area of conductors to the sectional area of the stator slot (space factor) has been required to be particularly highly increased in recent years.

For example, when electrical wires each having a circular cross-section are closely packed at the inside of a stator slot, the space serving as dead space and the cross-sectional area of the respective insulation coating become important factors. For this reason, users attempt to increase the packing factor as much as possible, by press-fitting more electrical wires into a stator slot, up to a extent that the electrical wire having a circular cross-section causes deformation. However, since reducing the cross-sectional area of the insulation coating sacrifices electrical performance thereof (insulation breakdown or the like), such reduction has not been desirable.

For the reasons discussed above, it has been lately attempted to use a rectangular wire in which the conductor has a shape similar to a quadrilateral (square or rectangle), as a means for increasing the packing factor. Use of a rectangular wire exhibits a dramatic effect in increasing the packing factor. However, since it is difficult to uniformly apply an insulation coating on a rectangular conductor, and since it is particularly difficult to control the thickness of the insulation coating in an insulated wire having a small cross-sectional area, the use of a rectangular wire does not become common.

The property of an insulation coating required for coil-winding of a motor or a transformer includes a property of keeping electrical insulation unchanged between before and after the coil-working (hereinafter referred to as an electrical insulation keeping property before and after the working). When the coating of an electrical wire is damaged upon the coil-working process, the electrical insulation performance deteriorates, which results in a loss of reliability for products.

Various methods have been conceived as the method of imparting this electrical insulation keeping property before and after the working to the coating of an electrical wire. Examples thereof include a method of reducing surface damage at the time of working into a coil, by imparting a lubricating property to the coating, and thereby lowering the coefficient of friction; and a method of retaining the electrical insulation performance, by improving the adhesiveness between the coating and the electrical conductor, and thereby preventing the coating from being peeled off from the conductor.

As the former method of imparting lubricating property, use has been traditionally employed of a method of applying a lubricant, such as wax, on the surface of an electrical wire; or a method of imparting lubricating property, by adding a lubricant to the insulation coating, and making the lubricant to bleed out to the surface of the electrical wire at the time of producing the electrical wire. There are many examples of the former method. However, since the method of imparting the lubricating property to a coating does not enhance the strength of the coating of the electrical wire itself, the method seems to be effective against the surface damage factors, but there has been in fact limitative on the effect at the time of coil-working.

The above-mentioned method of reducing the coefficient of friction of the surface of the insulation coating, which is a conventionally used means other than the means of imparting a lubricating property to the coating, includes a method of applying wax, oil, a surfactant, a solid lubricant, or the like onto the surface of an insulated wire, as described in Patent Literature 4 or the like. Further, it includes a method of applying a friction reducing agent containing a wax capable of being emulsified in water and a resin capable of being emulsified in water and solidified upon heating, and baking it before use, as described in Patent Literature 5 or the like. Further, it includes a method of enhancing lubrication by adding a fine powder of polyethylene to the insulation coated material itself, as described in Patent Literature 6 or the like. The above methods have been conceived so as to enhance the surface lubricating property of the insulated wire, and to consequently protect the insulation layer from surface damage through surface sliding of an electrical wire.

However, since these methods of adding a fine powder are complicated in the technique of adding the fine powder, and dispersing is difficult, a method of adding such a fine powder in the form of being dispersed in a solvent, into an insulation coated material, is employed in many cases.

These self-lubricating components can have an improvement of the self-lubricating property (coefficient of friction) by the lubricating components, but do not enhance properties such as reciprocating abrasion upon reduction in electrical insulation keeping property before and after the working, and as a result electrical insulation cannot be kept.

Furthermore, many types of self-lubricating components, such as polyethylene and poly (tetrafluoroethylene), become separated from the insulation coated material, due to a difference in the specific gravity between the insulation coated material and the self-lubricating components, and therefore a method of using these coated materials has a disadvantage for a practical use.

CITATION LIST

Patent Literatures

Patent Literature 1: JP-B-7-031944 ("JP-B" means examined Japanese patent publication)
Patent Literature 2: JP-A-63-195913 ("JP-A" means unexamined published Japanese patent application)
Patent Literature 3: JP-A-2005-203334
Patent Literature 4: JP-A-61-269808
Patent Literature 5: JP-A-62-200605
Patent Literature 6: JP-A-63-29412

SUMMARY OF INVENTION

Technical Problem

The present invention is contemplated for providing an inverter surge-resistant insulated wire, which is excellent in each of adhesive strength between a conductor and a resin layer coated thereon, adhesive strength among coated layers such as an enamel layer and an extrusion-coated layer, abrasion resistance, solvent resistance, and electrical insulation keeping property before and after the working, which has a high-partial discharge inception voltage, and which is capable of maintaining an excellent thermal aging resistance property over a long period of time of use, and providing a method of producing the same.

Solution to Problem

The present inventors, as the result of their intensive studies for dissolving the above-described problems which conventional arts have, have found that, in the insulated wire in which an extrusion-coated resin layer is provided around the outer side of the enamel layer, and an adhesive layer is provided between the enamel layer and the extrusion-coated resin layer, a property of a resin which composes the extrusion-coated resin layer, a thickness of the adhesive layer, and an individual thickness and a total thickness of the enamel layer and the extrusion-coated resin layer are significant for dissolving the problems. The present invention has been made on a basis of this finding.

The above-described problems can be solved by the following means.

(1) An inverter surge-resistant insulated wire, having at least one baked enamel layer around the outer periphery of a conductor having a rectangular cross-section, at least one extrusion-coated resin layer around the outer side thereof, and an adhesive layer having a thickness of 2 to 20 μm between the baked enamel layer and the extrusion-coated resin layer, wherein each of the at least one extrusion-coated resin layer on the adhesive layer is formed by the same resin, a cross-sectional shape of the baked enamel layer and the extrusion-coated resin layer in the cross-section of the inverter surge-resistant insulated wire is rectangular, and in the cross-sectional shape formed by the baked enamel layer and the extrusion-coated resin layer surrounding the conductor in a cross-sectional view, at least a pair of two sides of two pairs of two sides opposing at the upper side and the downside or at the right side and the left side with respect to the conductor each meet the conditions that a total thickness of the baked enamel layer and the extrusion-coated resin layer is 80 μm or more, a thickness of the baked enamel layer is 60 μm or less, a thickness of the extrusion-coated resin layer is 200 μm or less, and the resin of the extrusion-coated resin layer has a melting point of 300° C. or more and 370° C. or less.

(2) The inverter surge-resistant insulated wire as described in the above item (1), wherein the extrusion-coated resin layer is composed of a single layer.

(3) The inverter surge-resistant insulated wire as described in the above item (1) or (2), wherein a dielectric breakdown voltage after a 300° C. 168 hour heat treatment of the inverter surge-resistant insulated wire is 90% or more of the dielectric breakdown voltage before the heat treatment.

(4) The inverter surge-resistant insulated wire as described in any of the above items (1) to (3), wherein adhesive strength among coated layers of the inverter surge-resistant insulated wire is 100 g or more and less than 400 g.

(5) The inverter surge-resistant insulated wire as described in any one of the above items (1) to (4), wherein the extrusion-coated resin layer is a layer formed by at least one thermoplastic resin selected from the group consisting of polyether ether ketone, modified-polyether ether ketone, thermoplastic polyimide, and aromatic polyamide.

(6) The inverter surge-resistant insulated wire as described in any one of the above items (1) to (5), wherein the adhesive layer is a layer formed by at least one thermoplastic resin selected from the group consisting of polyetherimide, polyphenylsulfone, and polyethersulfone.

(7) The inverter surge-resistant insulated wire as described in any of the above items (1) to (6), wherein a peak voltage of the partial discharge inception voltage of the inverter surge-resistant insulated wire is 1200 Vp or more and 3200 Vp or less.

(8) A method of producing the inverter surge-resistant insulated wire as described in any of the above items (1) to (7) comprising:

baking a varnish-made resin on the outer periphery of the baked enamel layer to form the adhesive layer; and then extruding a thermoplastic resin for forming the extrusion-coated resin layer on the adhesive layer thereby to contact with the adhesive layer, the thermoplastic resin becoming a molten state at a higher temperature than a glass transition temperature of the resin that is used for the adhesive layer and heat-sealing the extrusion-coated resin on the baked enamel layer via the adhesive layer thereby to form the extrusion-coated resin layer.

Advantageous Effects of Invention

The inverter surge-resistant insulated wire of the present invention can be a wire, which is excellent in each of adhesive strength between a conductor and a resin layer to be coated thereon, adhesive strength among coated layers such as an enamel layer and an extrusion-coated layer, abrasion resistance, solvent resistance, and electrical insulation keeping property before and after the working, which has a high-partial discharge inception voltage, and which is capable of maintaining an excellent thermal aging resistance property over a long period of time of use.

MODE FOR CARRYING OUT THE INVENTION

The present invention is an inverter surge-resistant insulated wire which has at least one baked enamel layer around the outer periphery of a conductor, at least one extrusion-coated resin layer around the outer side thereof, and an adhesive layer between the baked enamel layer and the extrusion-coated resin layer. The thickness of the adhesive layer is 2 to 20 μm, a total thickness of the baked enamel layer and the extrusion-coated resin layer is 80 μm or more, a thickness of the baked enamel layer is 60 μm or less, a thickness of the extrusion-coated resin layer is 200 μm or less, and the resin of the extrusion-coated resin layer has a melting point of 300° C. or more and 370° C. or less. According to such structure, the inverter surge-resistant insulated wire of the present invention can be excellent in each of adhesive strength between a conductor and a resin layer to be coated thereon, adhesive strength among coated layers such as an enamel layer and an extrusion-coated layer, abrasion resistance, solvent resistance, and electrical insulation keeping property before and after the working, can have a high-partial discharge inception voltage, and can be capable of maintaining an excellent thermal aging resistance property over a long period of time of use.

Therefore, the inverter surge resistant insulated wire (hereinafter, also referred to as "insulated wire") of the present invention is favorable for a heat-resistant wiring, which can be used, for example, for coils for electrical equipments, such as inverter-related equipments, high-speed switching devices, inverter motors, and transformers, or for magnet wires or the like, for electrical equipments for aerospace use, electrical equipments for aircraft, electrical equipments for nuclear power, electrical equipments for energy, and electrical equipments for automobiles.

In the present invention, the conductor has a rectangular cross-section, and a total thickness of the baked enamel layer and the extrusion-coated resin layer is at least one of the total thicknesses of the baked enamel layer and the extrusion-coated resin layer provided respectively at two sides and at other two sides, the two sides being opposed to each other in the cross-section. Specifically, the inverter surge-resistant insulated wire has at least one baked enamel layer provided around the outer periphery of a conductor having a rectangular cross-section and at least one extrusion-coated resin layer provided around the outer side of the baked enamel layer, in which at least one total thickness of the total thicknesses of the baked enamel layer and the extrusion-coated resin layer provided respectively at two sides and at other two sides, the two sides being opposed to each other in the cross-section is 80 μm or more, a thickness of the baked enamel layer is 60 μm or less, a thickness of the extrusion-coated resin layer is 200 μm or less, and a resin of the extrusion-coated resin layer has a melting point of 300° C. or more and 370° C. or less.

If the total thicknesses of the extrusion-coated resin layer and the baked enamel layer formed at the two sides in which discharge occurs is a predetermined thickness, a partial discharge inception voltage can be maintained even if the total thicknesses of the layers formed at the other two sides is thinner than the former, and a rate of a total cross-sectional area of the motor with respect to the total cross-sectional area in a slot of the motor (space factor) can be increased. Therefore, the total thicknesses of the extrusion-coated resin layer and the baked enamel layer provided respectively at two sides and at other two sides may be of any thickness as long as the two sides in which discharge occurs, that is to say, at least one of them is 80 μm or more, and preferably each of the two sides and the other two sides is 80 μm or more.

As for the total thickness, the two sides may be the same or different from one another and it is preferable that they are different from one another in the following manner from the standpoint of the space factor with respect to the stator slot. Specifically, the partial discharge that occurs in the stator slot such as a motor can be divided into two classes of a case where a partial discharge occurs between a slot and a wire and a case where a partial discharge occurs between a wire and a wire. As a result, a rate of the total cross-sectional area of the motor with respect to the total cross-sectional area in a slot of the motor (space factor) can be increased while maintaining the value of partial discharge inception voltage, by using an insulated wire in which the thickness of the extrusion-coated resin layer provided at a flat surface is different from the thickness of the extrusion-coated resin layer provided at an edge surface of the insulated wire.

Here, the flat surface refers to a pair of the long side of two pairs of the two sides that oppose in a rectangular cross-section of the flat wire, while the edge surface refers to a pair of the short side of two pairs of the two sides that oppose.

In a case where a discharge occurs between a slot and a wire when wires which are different from one another in terms of the thickness in the edge surface and the flat surface are arranged in a row in a slot, they are arranged so that thick film surfaces contact with each other with respect to the slot, and they are arranged so that thin film surfaces of the neighboring wires contact with each other. The thinner the film thickness is, the more the number of wires can be inserted and space factor is increased. Besides, in this time, the value of a partial discharge inception voltage can be maintained. Similarly, in a case where discharge is easy to occur between a wire and a wire, if the surface having a thick film thickness is arranged so as to be a surface to contact with a wire whereas the surface which faces the slot is made thin, the space factor is increased because a size of the slot is not increased more than necessary. Besides, in this time, the value of a partial discharge inception voltage can be maintained.

In a case where the thickness of the extrusion-coated resin layer is different between a pair of two sides which are opposed to each other and a pair of the other two sides which are opposed to each other in the cross section, when provided that the thickness of the pair of two sides which are opposed to each other is 1, the thickness of the pair of the other two sides which are opposed to each other is preferably adjusted to a range of 1.01 to 5, and more preferably adjusted to a range of 1.01 to 3.

(Conductor)

As the conductor in the insulated wires of the present invention, use may be made of any conductor that has been conventionally used in insulated wires. The conductor is a conductor of preferably a low-oxygen copper whose oxygen content is 30 ppm or less, and more preferably a low-oxygen copper whose oxygen content is 20 ppm or less or oxygen-free copper. When the conductor is melted by heat for the purpose of welding if the oxygen content is 30 ppm or less, voids caused by contained oxygen are not occurred at a welded portion, the deterioration of the electrical resistance of the welded portion can be prevented, and the strength of the welded portion can be secured.

Further, a conductor, which has a desired transverse cross-sectional shape, may be used, and in terms of space factor with respect to the stator slot, it is preferable to use a conductor having a cross-sectional shape except for a circular shape, and particularly preferable to use a rectangular conductor. Furthermore, in terms of suppressing partial discharge from corners, it is preferable that chamfers (radius r) are formed at four corners.

(Baked Enamel Layer)

The baked enamel layer (hereinafter, may be referred to simply as "enamel layer") in the insulated wires of the present invention is formed by an enamel resin into at least one layer which may be a single layer or a multilayer.

Further in the present invention, the single layer means that even in a case where layers in which resins forming the layers and additives contained therein are the same in each of the layers, are laminated, these layers are regarded as the same layer, and on the other hand, even in a case that the layers are composed of the same resins, when compositions constituting the layers are different from one another such that, for example, a kind of additives or a compounding amount is different from one another, the number of the layers are counted.

This definition is also applied to layers other than the enamel layer.

As the enamel resin that forms the enamel layer, any of those conventionally utilized can be put to use, and examples include polyimide, polyamide-imide, polyesterimide, polyetherimide, polyimide hydantoin-modified polyester, polyamide, formal, polyurethane, polyester, polyvinylformal, epoxy, and polyhydantoin. As the enamel resin, polyimide-based resins, such as polyimide, polyamide-imide, polyesterimide, polyetherimide, and polyimide hydantoin-modified polyester, which are excellent in heat resistance is preferable. Of them, polyamide-imide and polyimide are more preferable, and polyamide-imide is particularly preferable. The enamel resins may be used singly alone, or may be used as a mixture of two or more kinds thereof.

In the present invention, in a case where the enamel layer is laminated with a plurality of layers, it is preferable that the same resin is used among these layers and each layer is preferably made by one kind of resin. In the present invention, it is particularly preferable that an enamel layer is a single layer.

From the standpoint that even if a thickness of the enamel layer is made thick whereby a high-partial discharge inception voltage can be attained, the number of passages through a baking furnace can be reduced when the enamel layer is formed, and adhesion between the conductor and the enamel layer can be prevented from being extremely lowered, the thickness of the enamel layer is 60 μm or less, and preferably 50 μm or less. Further, in order to prevent deterioration of voltage resistance or heat resistance, which are properties required for the enameled wires as insulated wires, it is preferable that the enamel layer has a certain thickness. The thickness of the enamel layer is not particularly limited, as long as it is a thickness where no pinholes are formed. The thickness of the enamel layer is preferably 3 μm or more, more preferably 6 μm or more, and further more preferably 30 μm or more. In this preferred embodiment, each of the thicknesses of the enamel layers provided respectively at two sides and at the other two sides has been adjusted to 60 μm or less.

The enamel layer can be formed, by coating of a resin varnish containing the above-mentioned the enamel resin onto a conductor and baking of the resin varnish, each of which is preferably made several times. A method of coating the resin varnish may be a usual manner. Examples of the method include a method using a die for coating varnish, which has a shape similar to the shape of a conductor, or a method using a die called "universal die" that is formed in the shape of a curb when the conductor has a quadrangular cross-section. The conductor to which the resin varnish is coated is baked in a baking furnace in a usual manner. Specific baking conditions depend on the shape of the furnace to be used. In the case of using a natural convection-type vertical furnace with length approximately 5 m, baking may be achieved by setting a transit time of 10 to 90 sec at 400 to 500° C.

(Extrusion-Coated Resin Layer)

In order to obtain an insulated wire having a high partial discharge inception voltage, at least one extrusion-coated resin layer of the insulated wire of the present invention is provided around the outer side of the baked enamel layer. The extrusion-coated resin layer may be a single layer or multilayers. Further in the present invention, in a case where the extrusion-coated resin layer is composed of multilayers, the same resin among the multilayers is used. Specifically, layers formed by the same resin as the resin contained in the extrusion-coated resin layer nearest the enamel layer side are laminated. Here, the presence or absence of additives other than the resin, and the kind or the compounding amount thereof may be different from one another among the multilayers, as long as the resin is the same. In the present invention, the extrusion-coated resin layer is preferably a single layer or double layers, and a single layer is particularly preferable.

The extrusion-coated resin layer is a layer of a thermoplastic resin, and the thermoplastic resin for forming the extrusion-coated resin layer is an extrusion-moldable thermoplastic resin. From the standpoints that in addition to the thermal aging resistance property, the electrical insulation keeping property before and after the working, adhesive strength between the enamel layer and the extrusion-coated resin layer, and solvent resistance are also excellent, a thermoplastic resin having a melting point of 310° C. or more and 370° C. or less is used. The lower limit of the melting point is preferably 330° C. or more and the upper limit of the melting point is preferably 360° C. or less. The melting point of the thermoplastic resin can be measured by Differential Scanning calorimetry (DSC) in accordance with a method described below.

As for the thermoplastic resin, the dielectric constant thereof is preferably 4.5 or less, and more preferably 4.0 or less, from the standpoint that a high-partial discharge inception voltage can be further increased. Here, the dielectric constant can be measured by commercially-available dielectric measuring-equipment. A measuring temperature and frequencies are changed as needed. In the present invention, however, these mean the values obtained by measurement at 25° C. and 50 Hz, unless otherwise described.

Examples of the thermoplastic resin which forms the extrusion-coated resin layer include polyether ether ketone (PEEK), modified-polyether ether ketone (modified-PEEK), thermoplastic polyimide (PI), aromatic polyamide having aromatic ring (referred as aromatic polyamide), polyester having aromatic ring (referred as aromatic polyester), polyketone (PK). Among them, at least one thermoplastic resin selected from the group consisting of polyether ether ketone, modified-polyether ether ketone, thermoplastic polyimide, and aromatic polyamide is preferable, polyether ether ketone and modified-polyether ether ketone are particularly preferable. Among these thermoplastic resins, those having a melting point of 300° C. or more and the dielectric constant of preferably 4.5 or less are used. The thermoplastic resin may be used singly alone, or two or more kinds thereof. Further, the thermoplastic resin may be a blend with other resins, elastomers or the like, as long as the blend is carried out in a degree that the melting point thereof is not out of the above-described range.

In the present invention, polyether ether ketone resins and modified polyether ether ketone resins are preferable. These may be used singly or blended. Among these, a single use is preferable.

The thickness of the extrusion-coated resin layer is less than 200 μm, and the thickness of less than 180 μm is preferable from the standpoint of attaining effects of the present invention. If the thickness of the extrusion-coated resin layer is too thick, when an insulated wire is wound around an iron core and heated, a whitened portion is sometimes formed on the insulated wire surface without relying on the rate of film crystallinity of the extrusion-coated resin layer described below. As just described, if the extrusion-coated resin layer is too thick, flexibility suitable for an insulated wire becomes poor because the extrusion-coated resin layer itself has stiffness, and as a result, the poor flexibility sometimes has an effect on a change of the electrical insulation keeping property before and after the working. On the other hand, the thickness of the extrusion-coated resin layer is preferably 5 μm or more, more preferably 15 μm or more, and still preferably 40 μm or more, from the standpoint that insulation failure can be prevented. In this preferred embodiment, each of the thicknesses of the extrusion-coated resin layers provided respectively at two sides and at the other two sides has been adjusted to 200 μm or less.

Here, in a case where a rate of crystallization of the extrusion-coated resin layer (may be also referred to as film crystallinity) is 50% or more, reduction in the electrical insulation keeping property before and after the working which is one of insulation properties becomes non-significant. In particular, even after winding it on an iron core and heating, dielectric breakdown voltage can be maintained. Therefore, as for the extrusion-coated resin layer, the film crystallinity thereof is preferably 50% or more, more preferably 60% or more, and particularly preferably 65% or more, in terms of the insulation properties, in particular, in the point that dielectric breakdown voltage after the winding and the heating can be maintained. The film crystallinity of the extrusion-coated resin layer can be measured using Differential Scanning calorimetry (DSC) [thermal analysis equipment "DSC-60" (manufactured by Shimadzu Corporation)].

Specifically, 10 mg of a film of the extrusion-coated resin layer are weighed and temperature thereof is elevated at the rate of 5° C./min. During this stage, a heat amount (melting heat amount) due to melting that is observed at the region more than 300° C. and a heat amount (crystallization heat amount) due to crystallization that is observed at round 150° C. are calculated and a difference of the heat amount in which the crystallization heat amount is deducted from the melting heat amount, with respect to the melting heat amount is defined as the film crystallinity. This calculation formula is shown below.

Calculation formula:

$$\text{the film crystallinity (\%)} = [(\text{the melting heat amount} - \text{the crystallization heat amount})/(\text{the melting heat amount})] \times 100$$

The extrusion-coated resin layer can be formed by extrusion-molding the above-described thermoplastic resin on an enamel layer having been formed on a conductor. The conditions at the time of extrusion-molding, for example, a condition of extrusion temperature are set appropriately according to the thermoplastic resin to be used. Taking an example of preferable extrusion temperatures, specifically the extrusion temperature is set at a temperature higher by about 40° C. to 60° C. than the melting point in order to achieve a melt viscosity suitable for the extrusion-coating. If the extrusion-coated resin layer is formed by the extrusion-molding as just described, there is no need to pass it through a baking furnace at the time of forming a coated resin layer in the production process. As a result, there is an advantage that a thickness of an insulation layer, namely the extrusion-coated resin layer can be made thick without growing the thickness of an oxidation-coated layer of the conductor.

In a case where the extrusion-coated resin layer is formed by the extrusion-molding, by taking the time of 10 seconds or more after a thermoplastic resin has been extrusion-molded above an enamel layer, and then cooling, for example water-cooling, or by cooling to about 250° C. with, for example, water after a thermoplastic resin has been extrusion-molded on an enamel layer, and then exposing it to outside air temperature for 2 seconds or more, the film crystallinity of the extrusion-coated resin layer can be adjusted to 50% or more whereby a desired dielectric breakdown voltage can be maintained.

(Adhesive Layer)

The adhesive layer is a layer of a thermoplastic resin, and as for the thermoplastic resin, any kind of resins may be used as long as they are a resin which is capable of heat-sealing an extrusion-coated resin layer to an enamel layer. It is preferable that these resins are non-crystalline resins which are easily soluble in a solvent, in view of the necessity to make them a varnish. Further, it is preferable that these are resins which are also excellent in heat resistance in order to prevent from reduction in heat resistance required for the insulated wire. In view of these points, examples of preferable thermoplastic resins include polysulfone (PSU), polyether sulfone (PES), polyether imide (PEI), polyphenyl sulfone (PPSU), and the like. Among these, preferred is at least one thermoplastic resin selected from the group consisting of polyether imide, polyphenyl sulfone, and polyether sulfone, each of which is a superior heat-resistant non-crystalline resin having a glass transition temperature (Tg) more than 200° C., and more preferred is polyether imide having a high compatibility with the extrusion-coated resin.

The thickness of the adhesive layer is preferably 2 to 20 μm, more preferably 3 to 15 μm, further more preferably 3 to 12 μm, and particularly preferably 3 to 10 μm.

Further, the adhesive layer may have a laminate structure composed of two or more layers. In this case, however, it is preferable that a resin in each layer is the same with respect to one another. In the present invention, the adhesive layer is preferably a single layer.

When the adhesive force between the extrusion-coated resin layer and the baked enamel layer is not sufficient, wrinkles of the extrusion-coated resin layer may occur in some cases, on the inner portion of an arc of the wire bent, under a severe working condition, for example, when the wire is bent at a small radius. When the wrinkles occur, a space occurs between the enamel layer and the extrusion-coated resin layer, which may result in a phenomenon of lowering of a partial discharge inception voltage in some cases. In order to prevent the lowering of the partial discharge inception voltage, it is necessary to prevent the wrinkles from being occurred on the inner part of the arc of the wire bent. Then, such an occurrence of the wrinkles can be prevented, by introducing a layer, which has an adhesive function, between the enamel layer and the extrusion-coated resin layer, to increase the adhesive force. Specifically, the insulated wire of the present invention exhibits a high partial discharge inception voltage because of a high adhesive strength between the enamel layer and the extrusion-coated resin layer, and by providing an adhesive layer between the enamel layer and the extrusion-coated resin layer, still higher partial discharge inception voltage is exerted and thereby inverter surge deterioration can be prevented effectively. Besides, further enhancement of adhesive strength between the enamel layer and the extrusion-coated resin layer allows solution of the problems such as delamination at the time of working.

The adhesive layer can be formed by baking the above-described thermoplastic resin on an enamel layer having been formed on a conductor. An insulated wire having the foregoing adhesive layer according to another preferable embodiment of the present invention can be produced preferably by baking a varnish-made thermoplastic resin on the outer periphery of the enamel layer to form the adhesive layer, and then extruding a thermoplastic resin for forming the extrusion-coated resin layer on the adhesive layer thereby to contact with the adhesive layer in the extrusion coating-process, the thermoplastic resin being a molten state at a higher temperature than a glass transition temperature of the resin that is used for the adhesive layer, and thereby heat-sealing the enamel layer and the extrusion-coated resin layer.

In this production method, in order to perform sufficient heat-sealing of the adhesive layer, namely of the enamel layer and the extrusion-coated resin layer, it is preferable that a heating temperature of a thermoplastic resin for forming the extrusion-coated resin layer in the extrusion-coating process is equal to or more than a glass transition temperature (Tg) of the thermoplastic resin that is used for the adhesive layer, and more preferably a temperature of at least 30° C. higher than Tg, and particularly preferably a temperature of at least 50° C. higher than Tg. Herein, the heating temperature of a thermoplastic resin for forming the extrusion-coated resin layer is a temperature of the die parts.

A solvent for varnish-making of a thermoplastic resin for forming the adhesive layer may be any solvent, as long as it is capable of dissolving a selected thermoplastic resin.

In this preferable embodiment, a total thickness of the enamel layer and the extrusion-coated resin layer is 80 μm or more. If the total thickness is 50 μm or more, a peak voltage (Vp) of the partial discharge inception voltage (V) of the insulated wire becomes 1000 Vp or more, while 80 μm or more results in 1200 Vp or more, which is preferable from the standpoint of prevention of inverter surge deterioration. This total thickness is particularly preferably 100 μm or more from the standpoint that this allows development of higher partial discharge inception voltage and a high level of prevention of inverter surge deterioration. In this preferable embodiment, it is preferable that at least, a total thickness of the enamel layer and the extrusion-coated resin layer of the two sides is 80 μm or more and a total thickness of the enamel layer and the extrusion-coated resin layer of one side of the other two sides is 50 μm or more. It is preferable above all that a total thickness of the enamel layer and the extrusion-coated resin layer provided respectively at both two sides is each 80 μm or more. It is more preferable that the above-described total thickness of at least unilateral two sides is 100 μm or more. It is preferable in particular that the above-described total thickness of both two sides is each 100 μm or more.

Further in the present invention, the peak voltage (Vp) of the partial discharge inception voltage (V) of the insulated wire is preferably 1200-3200 Vp.

(Measurement of Partial Discharge Inception Voltage)

The partial discharge inception voltage of the insulated wires is measured, using a partial discharge tester "KPD2050", manufactured by Kikusui Electronics Corp.

Two pieces of the respective insulated wire with a rectangular cross-section are brought into close contact with each other with plane contact at the planes of the long sides without any space therebetween over a length of 150 mm, thereby to produce a sample. An electrode is provided between the two conductors and connected to the conductors. Then, while an AC voltage of 50 Hz is applied, at a temperature 25° C., the voltage is continuously raised up. Base on the voltage (V) at the time when a partial discharge of 10 pC occurred, a peak voltage (Vp) is read.

As mentioned above, if the thickness of the enamel layer is adjusted to 60 μm or less, the thickness of the extrusion-coated resin layer is adjusted to 200 μm or less, and the total thickness of the enamel layer and the extrusion-coated resin layer is adjusted to 80 μm or above, at least partial discharge inception voltage of the insulated wire, namely prevention of inverter surge deterioration, adhesive strength between a conductor and a resin layer covering the conductor, adhesive strength among coated layers like a combination of the enamel layer and the extrusion-coated resin layer can be satisfied. Further, the total thickness of the enamel layer and the extrusion-coated resin layer is preferably 260 μm or less, and in order that a working can be done without any difficulty in view of the electrical insulation keeping property before and after the working, the total thickness of 235 μm or less is more preferable.

Therefore, as for the insulated wire of this preferable embodiment, both adhesive strength between a conductor and a coated layer such as an enamel layer and adhesive strength between coated layers are high.

These adhesive strengths can be evaluated, for example, in terms of rotation frequency until occurring of the float of the enamel layer, in accordance with the same way as described in the JIS C 3003 Methods of test for enamel wires, Section 8. Adhesiveness, 8.1 b) Torsion methods. Also for the rectangular wire having a square-shaped cross-section, evaluation can be made similarly. In the present invention, if the rotation frequency until float of the enamel layer or float of the coated layer of the upper layer in an interlayer of the coated layers occurs is 15 rounds or more, adhesiveness is judged as being good, and the insulated wire according to this preferable embodiment achieves 15 rounds or more of rotation frequency.

Specifically, the adhesive strength between a conductor and a coated layer (film layer) and the adhesive strength between coated layers are measured as described below and preferable adhesive strengths of these are as follows.

(Adhesive Strength with Conductor)

A wire specimen in which only an insulation coated layer closest to a conductor of the insulated wire has been partially peeled off is set in a tensile tester (for example, a tensile tester manufactured by Shimadzu Corporation "AUTOGRAPH AG-X"), and a tensile load by which float is caused when an extrusion-coated resin layer is torn upward at the rate of 4 mm/min (180° peeling), is the adhesive strength.

The tensile load by which float is caused is preferably 20 g or more and less than 40 g, and particularly preferably 40 g or more and less than 100 g.

(Adhesive Strength Between Coated Layers)

A wire specimen in which only an extrusion-coated resin layer of the insulated wire has been partially peeled off is set in a tensile tester (for example, a tensile tester manufactured by Shimadzu Corporation "AUTOGRAPH AG-X"), and a tensile load by which float is caused when an extrusion-coated resin layer is torn upward at the rate of 4 mm/min (180° peeling), is the adhesive strength.

The tensile load by which float is caused is preferably 100 g or more and less than 400 g.

In a case where an adhesive strength between coated layers is 400 g or more, because the adhesive strength is too strong, when crack is caused in a film of one layer of two layers due to oxidation degradation or thermal degradation, the other layer, even though it has not yet been deteriorated, sometimes causes crack together with the layer which has caused generation of the crack.

The insulated wire of the present invention is excellent in the thermal aging resistance property. The thermal aging resistance property provides an indication of ensuring reliability that insulation properties are not reduced even if used over a long period of time of use under a high temperature environment. It is preferable in particular that the dielectric breakdown voltage after the 300° C. 168 hour heat treatment is 90% or more, when compared with the dielectric breakdown voltage before the heat treatment.

The dielectric breakdown voltage after the 300° C. heat treatment can be measured as follows.

(Measurement of Dielectric Breakdown Voltage after 300° C. Heat Treatment)

300 mm of a linear one-sided insulated wire is cut off and subjected to a 300° C. 168 hour heat treatment. After the heat treatment, an aluminum foil is wound on a central portion thereof and coated layers at one terminal of the 300 mm are peeled, and then conduction between a peeled portion of the one terminal and the aluminum foil portion is permitted. The voltage at which dielectric breakdown is caused by elevating voltage at the rate of 500V/min is defined as "dielectric breakdown voltage after heating". Calculation is carried out using the expression: ("Dielectric breakdown voltage after heating"/"Dielectric Breakdown Voltage Before Heating")× 100.

Further, for evaluation of the thermal aging resistance property of the insulated wire, there is also a method of evaluating visually existence or non-existence of crack which is caused in an enamel layer or an extrusion-coated resin layer after still standing of a wound specimen for 1000 hours in a 190° C. high-temperature bath in accordance with JIS C 3003 enamel wire test method, Section 7.Flexibility. In the insulated wire of the present invention, generation of crack is not found even in this evaluation.

In the present invention, the electrical insulation keeping property before and after the working is also excellent.

The electrical insulation keeping property before and after the working is evaluated by winding the insulated wire on an iron core and then measuring dielectric breakdown voltage before and after heating, as described below.

(Measurement of Dielectric Breakdown Voltage after Winding on Iron Core and Heating)

Evaluation of the electrical insulation keeping property before and after heating is carried out as follows.

Specifically, an insulated wire is wound on an iron core having a diameter of 30 mm and hold for 30 minutes in a thermostat bath in which temperature is elevated to 280° C. After taking it out of the thermostat bath, the iron core at the state that the insulated wire is wound on the iron core is inserted into copper grains, and one end of the winding is connected to an electrode. It is preferable that 1 minute-conduction without causing dielectric breakdown at a voltage of 10 kV is maintained.

As described above, because a thermoplastic resin for forming the extrusion-coated resin layer is selected and both adhesive strength between a conductor and a coated layer and adhesive strength between coated layers are high, the insulated wire of the present invention is excellent in abrasion resistance and solvent resistance each of which is required for recent insulated wires. The abrasion resistance provides an indicator of the degree of abrasion incurred when the insulated wire is worked to a motor and the like, and coefficient of static friction provides a degree of easiness of penetration into a stator slot. The solvent resistance is required for the insulated wire from diversification of usage environment and assembly process.

The abrasion resistance can be evaluated, for example at 25° C. in the same manner as JIS C 3003 enamel wire test method, Section9.Abrasion resistance (Round wire). In a case of a rectangular wire having a square-shaped cross-section, evaluation is conducted with respect to four corners thereof. Specifically, the rectangular wire is slid in one direction using an abrasion tester prescribed by JIS C 3003 until a coating is peeled off under a certain load. Reading the scale at which the coating is peeled off, if a product of the value of scale and the used load is 2000 g or more, abrasion resistance can be assessed as being very excellent. The insulated wire of the present invention achieves 2000 g or more of the product of the value of scale and the used load.

Evaluation of the solvent resistance can be carried out by visual confirmation of a surface of an enamel layer or an extrusion-coated resin layer after soaking a wound specimen in a solvent for 10 seconds in accordance with JIS C 3003 enamel wire test method, Section 7.Flexibility. In the present invention, the test is carried out using 3 kinds of solvents including acetone, xylene, and styrene and at 2-level temperatures of room temperature and 150° C. (a specimen is heated at 150° C. for 30 minutes and then the specimen kept hot is soaked in a solvent). As a result, if there are no abnormalities in any of surfaces of the enamel layer or the extrusion-coated resin layer, solvent resistance can be assessed as being very excellent. In the insulated wire of the present invention, no abnormalities are seen with any solvent of acetone, xylene, or styrene, and at any of room temperature and 150° C., and in any of surfaces of the enamel layer and the extrusion-coated resin layer.

(Method of Producing an Insulated Wire)

The method of producing the insulated wire is as explained in individual layers.

That is, a varnish-made resin on the outer periphery of the baked enamel layer is baked to form the adhesive layer. And then, a thermoplastic resin for forming the extrusion-coated resin layer, the thermoplastic resin becoming a molten state at a higher temperature than a glass transition temperature of the resin that is used for the adhesive layer, is extruded onto the adhesive layer thereby to contact with the adhesive layer, and the extrusion-coated resin is heat-sealed to the baked enamel layer via the adhesive layer thereby to form the extrusion-coated resin layer.

Here, in the present invention, the adhesive layer is not coated by extruding, but provided by coating a varnish-made resin.

EXAMPLES

The present invention is described in more detail based on examples given below, but the present invention is not limited by the following examples.

Example 1

A rectangular conductor (copper of oxygen content 15 ppm) was provided, which had a dimension of 1.8 mm×3.4 mm (thickness×width) and a chamfer radius r of 0.3 mm at four corners. In forming an enamel layer, the conductor was coated with a polyamideimide resin (PAI) varnish (trade name: HI406, manufactured by Hitachi Chemical Co., Ltd.), by using a die with a shape similar to the shape of the conductor, followed by passing through an 8 m-long baking furnace set to 450° C., at a speed so that the baking time period would be 15 sec, thereby to form an enamel of thickness 5 via this one step of baking. This step was repeated eight times, to form an enamel layer with thickness 40 μm, thereby to obtain an enameled wire.

Next, a resin varnish in which a polyetherimide resin (PEI) (manufactured by SABIC Innovative Plastics, Trade name: ULTEM 1010) had been dissolved in N-methyl-2-pyrrolidone (NMP) so as to be a 20-wt % solution was coated on the foregoing enameled wire, by using a die with a shape similar to the shape of the conductor, and then passing it through an 8 m-long baking furnace set to 450° C., at a speed so that the baking time period would be 15 seconds. By repeating the foregoing coating process of forming a 5 μm thick-adhesive layer per one coating (the thickness formed by one baking process was 5 μm), an enamel wire with a 45 μm-thick adhesive layer was obtained.

The obtained enamel wire with the adhesive layer was used as a core wire, and a screw of the extruder having 30 mm fullflight, L/D=20, and compression ratio=3 was used. As the material, polyether ether ketone (PEEK) (manufactured by Solvay Specialty Polymers, trade name: KETASPAIRE KT-820, dielectric constant 3.1) was used. Extrusion was carried out under the conditions of extrusion temperature shown in Table 1. The symbols C1, C2 and C3 denote a cylinder temperature in the extruder, and each indicate temperatures of 3 zones in this order from the input side of a resin. The symbols H and D denote temperatures of a head section and a die section, respectively. Also note that at this stage, the extrusion temperature of a thermoplastic resin for forming the extrusion-coated resin layer was higher by 183° C. than the glass transition temperature (217° C.) of PD for forming the adhesive layer at the D point (400° C.). Extrusion coating of PEEK was carrying out using an extruding die, and then water-cooled at interval of 10 seconds to form a 40 μm-thick extrusion-coated resin layer around the outer side of the enamel layer. Thus, an insulated wire composed of the PEEK extrusion-coated enamel wire having a total thickness (a total of thicknesses of the enamel layer and the extrusion-coated resin layer) of 80 μm was obtained.

Examples 2 to 18 and Comparative Examples 1 to 10 and 13

Each of insulated wires was obtained in the same manner as in Example 1, except that the kind and the thickness of each of the resin of the enamel layer, the resin of the adhesive layer, and the resin of the extrusion-coated resin layer were changed to those shown in the following Tables 2 to 6. Also note that extrusion was carried out under the conditions of extrusion temperature shown in Table 1. Also note that the extrusion-coated resin layer is expressed as extrusion-coated layer in Tables 2 to 6.

In Tables 2 to 6, polyimide resin (PI) varnish (manufactured by UNITIKA Limited, trade name: U imide) was used for the enameled layer of example 13, polyphenyl sulfone (PPSU) (manufactured by Solvay Specialty Polymers, trade name: Radel RS800, glass transition temperature: 220° C.) was used for the adhesive layer of Examples 9, 10 and Comparative Example 2. Further, In Example 14, modified polyether ether ketone resin (modified PEEK) (manufactured by Solvay Specialty Polymers, trade name: AvaSpire AV-650, dielectric constant 3.1) was used to form the extrusion-coated resin layer. In Comparative Example 10, polyphenylenesulfide resin (PPS) (manufactured by DIC Corporation, trade name: FZ-2100, dielectric constant 3.4) was used to form the extrusion-coated resin layer.

(The Conditions of Extrusion Temperature)

The conditions of extrusion temperature of Examples and Comparative Examples are shown in the Table 1, respectively.

In Table 1, C1, C2 and C3 indicate 3 zones in which temperature control in the cylinder portion of the extruder is carried out in parts, in this order from the input side of materials. Further, H indicates a head located posterior to the cylinder of the extruder. Further, D indicates a die at the end of the head.

TABLE 1

| Thermoplastic resin which forms extrusion-coated resin layer | | PEEK | Modified-PEEK | PPS |
|---|---|---|---|---|
| The conditions of extrusion temperature | C1 (° C.) | 300 | 300 | 260 |
| | C2 (° C.) | 380 | 380 | 300 |
| | C3 (° C.) | 380 | 380 | 310 |
| | H (° C.) | 390 | 390 | 320 |
| | D (° C.) | 400 | 400 | 330 |

Comparative Examples 11 and 12

Enamel wires with adhesive layers having thicknesses shown in the following Table 6 were obtained in the same manner as in Example 1, except that the polyamideimide resin (PAI) used in Example 1 was used as a resin of the enamel layer, and a phenoxy resin was used as a resin of the adhesive layer. The extrusion-coated resin layer was formed using different types of resins shown in the following Table 6 in such a way that a polyethersulfone resin (PES) (manufactured by Sumitomo Chemical Co., Ltd., trade name: SUMIKAEXCEL 4800G) was provided at the adhesive layer side, and a modified polyether ether ketone resin (modified PEEK) used in Example 14 or a polyphenylenesulfide resin (PPS) used in Comparative Example 10 was provided at the side opposite to the adhesive layer. Also note that contrary to Example 1, the water cooling after extrusion coating with use of an extruding die was not carried out.

Evaluations of the thus-produced insulated wires of Examples 1 to 18 and Comparative Examples 1 to 13 were carried out as follows.

(Melting Point)

Temperature of 10 mg of the extrusion-coated resin layer was elevated at the rate of 5° C./min using thermal analysis equipment "DSC-60" (manufactured by Shimadzu Corporation), and during this stage, a peak temperature of the heat amount due to melting that was observed at the region more than 250° C. was read and defined as a melting point. Also note that when there is a plurality of peak temperatures, the peak temperature of higher temperature is defined as a melting point.

(Measurement of Dielectric Breakdown Voltage after Winding on Iron Core and Heating)

Evaluation of the electrical insulation keeping property before and after heating was carried out as follows. Specifically, an insulated wire was wound on an iron core having a diameter of 30 mm and held for 30 minutes in a thermostat bath in which temperature was elevated to 280° C. After taking it out of the thermostat bath, the iron core at the state that the insulated wire was wound on the iron core was inserted into copper grains, and one end of the winding was connected to an electrode. Then, retention of 1 minute-conduction without causing dielectric breakdown at a voltage of 10 kV was evaluated as a pass. In Tables 2 to 6, the pass is expressed by "○" whereas a rejection by "x". Also note that failure to retain 1 minute-conduction at a voltage of 10 kV which resulted in dielectric breakdown was evaluated as the rejection. In a case where dielectric breakdown is caused, the flexibility of the wire becomes poor and a change such as whitening and the like is caused on a wire surface, and even a crack is sometimes caused.

(Adhesive Strength with a Conductor)

Firstly, wire specimens in which only an insulation coated layer closest to a conductor of the insulated wire had been partially peeled off was set in a tensile tester manufactured by Shimadzu Corporation "AUTOGRAPH AG-X", and an extrusion-coated resin layer was torn upward at the rate of 4 mm/min (180° peeling).

The cases where the tensile load which was read at this stage was 40 g or more and less than 100 g were indicated as "⊙" in Tables 2 to 6, the cases of 20 g or more and less than 40 g were indicated as "○", and the cases of less than 20 g were indicated as "x".

(Adhesive Strength Between Coated Layers)

Firstly, wire specimens in which only an extrusion-coated resin layer of the insulated wire had been partially peeled off was set in a tensile tester manufactured by Shimadzu Corporation "AUTOGRAPH AG-X", and the extrusion-coated resin layer was torn upward at the rate of 4 mm/min (180° peeling).

The cases where the tensile load which was read at this stage was 100 g or more and less than 400 g were indicated as "⊙" in Tables 2 to 6, the cases of 40 g or more and less than 100 g were indicated as "○", and the cases of less than 40 g were indicated as "x".

(Measurement of Partial Discharge Inception Voltage)

The partial discharge inception voltage of the insulated wires was measured, using a partial discharge tester "KPD2050", manufactured by Kikusui Electronics Corp. Two pieces of the respective insulated wire with a rectangular cross-section were brought into close contact with each other with plane contact at the planes of the long sides without any space therebetween over a length of 150 mm, thereby to produce a sample. An electrode was provided between the two conductors and connected to the conductors. Then, while an AC voltage of 50 Hz was applied, at a temperature 25° C., the voltage was continuously raised up. Base on the voltage (V) at the time when a partial discharge of 10 pC occurred, a peak voltage (Vp) was read. A range of 1200 to 3200 Vp is a level of the pass.

(Measurement of Dielectric Breakdown Voltage after 300° C. Heat Treatment) 300 mm of a linear one-sided insulated wire was cut off and subjected to a 300° C. 168 hour heat treatment. After the heat treatment, an aluminum foil was wound on a central portion thereof and coated layers at one terminal of the 300 mm was peeled, and then conduction between a peeled portion of the one terminal and the aluminum foil portion was permitted. The voltage at which dielectric breakdown was caused by elevating voltage at the rate of 500V/min was defined as "dielectric breakdown voltage after heating". Calculation was carried out using the expression: ("Dielectric breakdown voltage after heating"/"Dielectric breakdown voltage before heating")×100. The case where the obtained value is 90% or more and 100% or less was indicated as "⊙" in Tables 2 to 6, the case of 70% or more and less than 90% was indicated as "○", the case of 30% or more and less than 70% was indicated as "Δ", and the case of less than 30% was indicated as "x".

(Total Evaluation)

The total evaluation was based on whether or not the target has applicability to recent electric equipment which is required to maintain an excellent thermal aging resistance property over a longer period of time. Specifically, in the case where evaluation of each of the dielectric breakdown voltage after winding on iron core and heating, the dielectric breakdown voltage after heating, the adhesive strength with a conductor and the adhesive strength between coated layers is "○" and evaluation of the 300° C. heat resistance property is "⊙", the total evaluation is "○" and evaluation of the cases other than the foregoing is "x".

These results are shown together in the following Tables 2 to 6.

TABLE 2

| | | Level required | Ex 1 | Ex 2 | Ex 3 | Ex 4 | Ex 5 | Ex 6 |
|---|---|---|---|---|---|---|---|---|
| | Enamel layer | 60 μm or less | PAI (thickness 40 μm) | PAI (thickness 55 μm) | PAI (thickness 20 μm) | PAI (thickness 35 μm) | PAI (thickness 15 μm) | PAI (thickness 31 μm) |
| | Adhesive layer | 2-20 μm | PEI (thickness 5 μm) | PEI (thickness 6 μM) | PEI (thickness 5 μm) | PEI (thickness 5 μm) | PEI (thickness 6 μm) | PEI (thickness 9 μm) |
| | Extrusion-coated layer | 200 μm or less | PEEK (thickness 40 μm) | PEEK (thickness 30 μm) | PEEK (thickness 72 μm) | PEEK (thickness 70 μm) | PEEK (thickness 105 μm) | PEEK (thickness 97 μm) |
| | Total thickness of Enamel layer and Extrusion-coated resin layer | 80 μm or more | 80 μm | 85 μm | 92 μm | 105 μm | 120 μm | 128 μm |
| | Total thickness | | 85 μm | 91 μm | 97 μm | 110 μm | 126 μm | 137 μm |
| Melting point of resin of the extrusion-coated resin layer | | 300-370° C. | 343° C. | 343° C. | 343° C. | 343° C. | 343° C. | 343° C. |
| Wire Properties | Dielectric breakdown voltage after winding on iron core and heating evaluation | ○ | ○ | ○ | ○ | ○ | ○ | ○ |
| | Adhesive strength with a conductor | ○ | ⊙ | ⊙ | ⊙ | ⊙ | ⊙ | ⊙ |
| | Adhesive strength between coated layers | ○ | ⊙ | ⊙ | ⊙ | ⊙ | ⊙ | ⊙ |

TABLE 2-continued

| | Level required | Ex 1 | Ex 2 | Ex 3 | Ex 4 | Ex 5 | Ex 6 |
|---|---|---|---|---|---|---|---|
| Partial discharge-occurring voltage | 1200-3200 Vp | 1350 Vp | 1400 Vp | 1420 Vp | 1600 Vp | 1750 Vp | 1870 Vp |
| 300° C. heat resistance property | ◎ | ◎ | ◎ | ◎ | ◎ | ◎ | ◎ |
| Total evaluation | ○ | ○ | ○ | ○ | ○ | ○ | ○ |

"Ex" means Example according to the present invention.

TABLE 3

| | | Level required | Ex 7 | Ex 8 | Ex 9 | Ex 10 | Ex 11 | Ex 12 |
|---|---|---|---|---|---|---|---|---|
| | Enamel layer | 60 μm or less | PAI (thickness 45 μm) | PAI (thickness 60 μm) | PAI (thickness 30 μm) | PAI (thickness 31 μm) | PAI (thickness 15 μm) | PAI (thickness 31 μm |
| | Adhesive layer | 2-20 μm | PEI (thickness 7 μm) | PEI (thickness 8 μm) | PPSU (thickness 9 μm) | PPSU (thickness 10 μm) | PEI (thickness 6 μm) | PEI (thickness 11 μm) |
| | Extrusion-coated layer | 200 μm or less | PEEK (thickness 91 μm) | PEEK (thickness 73 μm) | PEEK (thickness 126 μm) | PEEK (thickness 151 μm) | PEEK (thickness 172 μm) | PEEK (thickness 153 μm) |
| | Total thickness of Enamel layer and Extrusion-coated resin layer | 80 μm or more | 136 μm | 133 μm | 156 μm | 182 μm | 187 μm | 184 μm |
| | Total thickness | | 143 μm | 141 μm | 165 μm | 192 μm | 193 μm | 195 μm |
| | Melting point of resin of the extrusion-coated resin layer | 300-370° C. | 343° C. | 343° C. | 343° C. | 343° C. | 343° C. | 343° C. |
| Wire Properties | Dielectric breakdown voltage after winding on iron core and heating evaluation | ○ | ○ | ○ | ○ | ○ | ○ | ○ |
| | Adhesive strength with a conductor | ○ | ◎ | ◎ | ◎ | ◎ | ◎ | ◎ |
| | Adhesive strength between coated layers | ○ | ◎ | ◎ | ◎ | ◎ | ◎ | ◎ |
| | Partial discharge-occurring voltage | 1200-3200 Vp | 1910 Vp | 1900 Vp | 2150 Vp | 2520 Vp | 2500 Vp | 2450 Vp |
| | 300° C. heat resistance property | ◎ | ◎ | ◎ | ◎ | ◎ | ◎ | ◎ |
| | Total evaluation | ○ | ○ | ○ | ○ | ○ | ○ | ○ |

"Ex" means Example according to the present invention.

TABLE 4

| | | Level required | Ex 13 | Ex 14 | Ex 15 | Ex 16 | Ex 17 | Ex 18 |
|---|---|---|---|---|---|---|---|---|
| | Enamel layer | 60 μm or less | PI (thickness 32 μm) | PAI (thickness 35 μm) | PAI (thickness 30 μm) | PAI (thickness 10 μm) | PAI (thickness 35 μm) | PAI (thickness 60 μm) |
| | Adhesive layer | 2-20 μm | PEI (thickness 9 μm) | PEI (thickness 7 μm) | PEI (thickness 10) μm | PEI (thickness 6 μm) | PEI (thickness 7 μm) | PEI (thickness 6 μm) |
| | Extrusion-coated layer | 200 μm or less | PEEK (thickness 154 μm) | Modified-PEEK (thickness 149 μm) | PEEK (thickness 171 μm) | PEEK (thickness 198 μm) | PEEK (thickness 198 μm) | PEEK (thickness 181 μm) |
| | Total thickness of Enamel layer and Extrusion-coated resin layer | 80 μm or more | 186 μm | 184 μm | 201 μm | 208 μm | 233 μm | 241 μm |
| | Total thickness | | 195 μm | 191 μm | 211 μm | 214 μm | 240 μm | 247 μm |
| | Melting point of resin of the extrusion-coated resin layer | 300-370° C. | 343° C. | 343° C. | 343° C. | 343° C. | 343° C. | 343° C. |
| Wire Properties | Dielectric breakdown voltage after winding on iron core and heating evaluation | ○ | ○ | ○ | ○ | ○ | ○ | ○ |
| | Adhesive strength with a conductor | ○ | ◎ | ◎ | ◎ | ◎ | ◎ | ◎ |
| | Adhesive strength between coated layers | ○ | ◎ | ◎ | ◎ | ◎ | ◎ | ◎ |
| | Partial discharge-occurring voltage | 1200-3200 Vp | 2500 Vp | 2400 Vp | 2620 Vp | 2400 Vp | 3050 Vp | 3120 Vp |

TABLE 4-continued

| | Level required | Ex 13 | Ex 14 | Ex 15 | Ex 16 | Ex 17 | Ex 18 |
|---|---|---|---|---|---|---|---|
| 300° C. heat resistance property | ◎ | ◎ | ◎ | ◎ | ◎ | ◎ | ◎ |
| Total evaluation | ○ | ○ | ○ | ○ | ○ | ○ | ○ |

"Ex" means Example according to the present invention.

TABLE 5

| | | Level required | C Ex 1 | C Ex 2 | C Ex 3 | C Ex 4 | C Ex 5 | C Ex 6 | C Ex 7 |
|---|---|---|---|---|---|---|---|---|---|
| | Enamel layer | 60 μm or less | PAI (thickness 45 μm) | — | — | PAI (thickness 38 μm) | PAI (thickness 15 μm) | PAI (thickness 40 μm) | PAI (thickness 65 μm) |
| | Adhesive layer | 2-20 μm | — | PPSU (thickness 10 m) | — | PEI (thickness 10 μm) | PEI (thickness 6 μm) | PEI (thickness 6 m) | PEI (thickness 10 m) |
| | Extrusion-coated layer | 200 μm or less | PEEK (thickness 102 m) | PEEK (thickness 145 μm) | PEEK (thickness 171 μm) | — | PEEK (thickness 42 μm) | PEEK (thickness 20 μm) | PEEK (thickness 91 μm) |
| | Total thickness of Enamel layer and Extrusion-coated resin layer | 80 μm or more | 147 μm | 145 μm | 171 μm | 38 μm | 57 μm | 60 μm | 156 μm |
| | Total thickness | | 147 μm | 155 μm | 171 μm | 48 μm | 63 μm | 66 μm | 166 μm |
| | Melting point of resin of the extrusion-coated resin layer | 300-370° C. | 343° C. | 343° C. | 343° C. | — | | 343° C. | 343° C. |
| Wire Properties | Dielectric breakdown voltage after winding on iron core and heating evaluation | ○ | ○ | X | ○ | ○ | ○ | ○ | ○ |
| | Adhesive strength with a conductor | ○ | ◎ | X | ◎ | ◎ | ◎ | ◎ | X |
| | Adhesive strength between coated layers | ○ | X | ◎ | — | ◎ | ◎ | ◎ | ◎ |
| | Partial discharge-occurring voltage | 1200-3200 Vp | 1950 Vp | 2050 Vp | 2220 Vp | 950 Vp | 1000 Vp | 1020 Vp | 2140 Vp |
| | 300° C. heat resistance property | ◎ | ◎ | ◎ | X | X | ◎ | ◎ | ◎ |
| | Total evaluation | ○ | ○ | X | X | X | X | X | X |

"C Ex" means Comparative Example.

TABLE 6

| | | Level required | C Ex 8 | C Ex 9 | C Ex 10 | C Ex 11 | C Ex 12 | C Ex 13 |
|---|---|---|---|---|---|---|---|---|
| | Enamel layer | 60 μm or less | PAI (thickness 70 μm) | PAI (thickness 35 μm) | PAI (thickness 35 μm) | PAI (thickness 40 μm) | PAI (thickness 40 μm) | PAI (thickness 25 μm) |
| | Adhesive layer | 2-20 μm | PEI (thickness 5 μm) | PEI (thickness 7 μm) | PEI (thickness 10 μm) | Phenoxy (thickness 5 μm) | Phenoxy (thickness 5 μm) | — |
| | Extrusion-coated layer | 200 μm or less | PEEK (thickness 173 μm) | PEEK (thickness 220 μm) | PPS (thickness 121 μm) | PES (50 μm) + modified-PEEK (50 μm) | PES (50 μm) + PPS (50 μm) | PEEK (thickness 75 μm) |
| | Total thickness of Enamel layer and Extrusion-coated resin layer | 80 μm or more | 243 μm | 255 μm | 156 μm | 140 μm | 140 μm | 100 μm |
| | Total thickness | | 248 μm | 262 μm | 166 μm | 145 μm | 145 μm | 100 μm |
| | Melting point of resin of the extrusion-coated resin layer | 300-370° C. | 343° C. | 343° C. | 278° C. | 340° C. | 278° C. | 343° C. |
| Wire Properties | Dielectric breakdown voltage after winding on iron core and heating evaluation | ○ | ○ | X | ○ | ○ | ○ | ○ |
| | Adhesive strength with a conductor | ○ | X | ◎ | ◎ | ◎ | ◎ | ◎ |
| | Adhesive strength between coated layers | ○ | ◎ | ◎ | ○ | X | X | X |

TABLE 6-continued

| | Level required | C Ex 8 | C Ex 9 | C Ex 10 | C Ex 11 | C Ex 12 | C Ex 13 |
|---|---|---|---|---|---|---|---|
| Partial discharge-occurring voltage | 1200-3200 Vp | 3100 Vp | 3180 Vp | 2150 Vp | 1800 Vp | 1800 Vp | 1540 Vp |
| 300° C. heat resistance property | ◎ | ◎ | ◎ | X | ◎ | X | ◎ |
| Total evaluation | ○ | X | X | X | X | X | X |

"C Ex" means Comparative Example.

As is apparent from the above Tables 2 to 6, it was found that if the adhesive layer has a thickness of 2 to 20 μm, a total thickness of the baked enamel layer and the extrusion-coated resin layer is 80 μm or more, a thickness of the baked enamel layer is 60 μm or less, a thickness of the above-described extrusion-coated resin layer is 200 μm or less, and a melting point of a resin of the extrusion-coated resin layer is 300° C. or more and 370° C. or less, the dielectric breakdown voltage evaluation before and after heating which is an electrical insulation keeping property before and after working is excellent, both the adhesive strength between a conductor and a coated layer and the adhesive strength between coated layers are strong, the partial discharge inception voltage is high, and further both the abrasion resistance and the solvent resistance are excellent, and in addition to these, an excellent thermal aging resistance property can be maintained over a long period of time in view of the 300° C. heat resistance property.

Specifically, from the comparison between Examples 1 to 18 and Comparative Examples 1 to 4 and 13, it is found that it is necessary to have each of the baked enamel layer, the adhesive layer, and the extrusion-coated resin layer. In particular, in a case where only the extrusion-coated resin layer is provided as in Comparative Example 3 or the extrusion-coated resin layer is not provided as in Comparative Example 4, the 300° C. heat resistance property is inferior. In a case where the adhesive layer is not provided as in Comparative Examples 1 and 13, the adhesive strength between coated layers is inferior. Further, if the enamel layer is not provided as in Comparative Example 2, or the thickness of the enamel layer is thick as in Comparative Example 8, the adhesive strength with a conductor is inferior. By contraries, if the thickness of the extrusion-coated resin layer exceeds 200 μm as in Comparative Example 9, the dielectric breakdown voltage after winding on iron core and heating are inferior. If the thickness of the enamel layer is thick as in Comparative Example 7, the adhesive strength between a conductor and a coated layer is inferior.

Further, if a total thickness of the enamel layer and the extrusion-coated resin layer is less than 80 μm as in Comparative Examples 5 and 6, the partial discharge inception voltage reduces.

Further, if a thermoplastic resin having a melting point of 300° C. or more is used as a resin for forming an extrusion-coated resin layer, the thermal aging resistance property over a long period of time can be satisfied. On the other hand, if a thermoplastic resin having a melting point of less than 300° C. is used, the 300° C. heat resistance property is inferior as in Comparative Examples 10 and 12. Further, in Comparative Examples 11 and 12, the adhesive strength between coated layers is inferior. It is thought that this is mainly because for the cause of a double-layered laminate structure of the extrusion-coated resin layer formed of a different resin from one another, the adhesive strength between these extrusion-coated resin layers is inferior in particular.

Also note that the crystallinity of film of each of the extrusion-coated resin layers in Examples 1 to 18 in accordance with the above-described measuring method was 50% or more. Of the Examples, the crystallinity was 62% in Example 10, 65% in Example 12, and 71% in Example 13, respectively. Further, Satisfaction of both the above-described abrasion resistance and the solvent resistance has been confirmed in each of the insulated wires in Examples 1 to 18.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority on Patent Application No. 2012-263749 filed in Japan on Nov. 30, 2012, which is entirely herein incorporated by reference.

The invention claimed is:

1. An inverter surge-resistant insulated wire, having at least one baked enamel layer around the outer periphery of a conductor having a rectangular cross-section, at least one extrusion-coated resin layer around the outer side thereof, and an adhesive layer having a thickness of 2 to 20 μm between the baked enamel layer and the extrusion-coated resin layer, wherein each of the at least one extrusion-coated resin layer on the adhesive layer is formed by the same resin, a cross-sectional shape of the baked enamel layer and the extrusion-coated resin layer in the cross-section of the inverter surge-resistant insulated wire is rectangular, and in the cross-sectional shape formed by the baked enamel layer and the extrusion-coated resin layer surrounding the conductor in a cross-sectional view, at least a pair of two sides of two pairs of two sides opposing at the upper side and the downside or at the right side and the left side with respect to the conductor each meet the conditions that a total thickness of the baked enamel layer and the extrusion-coated resin layer is 80 μm or more, a thickness of the baked enamel layer is 60 μm or less, a thickness of the extrusion-coated resin layer is 200 μm or less, the resin of the extrusion-coated resin layer has a melting point of 300° C. or more and 370° C. or less, the adhesive layer is a layer of a thermoplastic resin selected from the group consisting of polysulfone, polyether sulfone, polyether imide, and polyphenyl sulfone, a film crystallinity of the extrusion-coated resin layer, which can be measured using Differential Scanning calorimetry and the following calculation formula, is 50% or more:

the film crystallinity (%)=[(the melting heat amount−the crystallization heat amount)/(the melting heat amount)]×100, and Calculation formula:

a peak voltage of the partial discharge inception voltage of the inverter surge-resistant insulated wire is 1200 Vp or more and 3200 Vp or less.

2. The inverter surge-resistant insulated wire according to claim 1, wherein the extrusion-coated resin layer is composed of a single layer.

3. The inverter surge-resistant insulated wire according to claim 1, wherein a dielectric breakdown voltage after a 300° C. 168 hour heat treatment of the inverter surge-resistant insulated wire is 90% or more of the dielectric breakdown voltage before the heat treatment.

4. The inverter surge-resistant insulated wire according to claim 1, wherein adhesive strength among coated layers of the inverter surge-resistant insulated wire is 100 g or more and less than 400 g.

5. The inverter surge-resistant insulated wire according to claim 1, wherein the extrusion-coated resin layer is a layer formed by at least one thermoplastic resin selected from the group consisting of polyether ether ketone, modified-polyether ether ketone, thermoplastic polyimide, and aromatic polyamide.

6. The inverter surge-resistant insulated wire according to claim 1, wherein the adhesive layer is a layer formed by at least one thermoplastic resin selected from the group consisting of polyetherimide, polyphenylsulfone, and polyethersulfone.

7. A method of producing the inverter surge-resistant insulated wire according to claim 1 comprising:

baking a varnish-made resin on the outer periphery of the baked enamel layer to form the adhesive layer; and then extruding a thermoplastic resin for forming the extrusion-coated resin layer on the adhesive layer thereby to contact with the adhesive layer, the thermoplastic resin becoming a molten state at a higher temperature than a glass transition temperature of the resin that is used for the adhesive layer and heat-sealing the extrusion-coated resin on the baked enamel layer via the adhesive layer thereby to form the extrusion-coated resin layer.

* * * * *